US006757935B1

(12) United States Patent
Sjoberg

(10) Patent No.: US 6,757,935 B1
(45) Date of Patent: Jul. 6, 2004

(54) INSTALLATION OF A MOTOR IN A VACUUM CLEANER

(75) Inventor: Jan Sjoberg, Arnal (SE)

(73) Assignee: Nilfisk Advance A/S, Brondby (DK)

( * ) Notice: Subject to any disclaimer, the term of this patent is extended or adjusted under 35 U.S.C. 154(b) by 0 days.

(21) Appl. No.: 09/958,003

(22) PCT Filed: Mar. 29, 2000

(86) PCT No.: PCT/DK00/00151

§ 371 (c)(1),
(2), (4) Date: Feb. 13, 2002

(87) PCT Pub. No.: WO00/59364

PCT Pub. Date: Oct. 12, 2000

(30) Foreign Application Priority Data

Mar. 30, 1999 (DK) ..... 1999 00420

(51) Int. Cl.[7] ..... A47L 5/12; A47L 5/22
(52) U.S. Cl. ..... 15/413; 15/353
(58) Field of Search ..... 15/314, 353, 413

(56) References Cited

U.S. PATENT DOCUMENTS 2,884,185 A * 4/1959 Dolan ..... 417/368
3,780,397 A * 12/1973 Harbeck et al. ..... 15/413
3,815,172 A * 6/1974 Fromknect et al. ..... 15/413
4,114,231 A 9/1978 Nauta
4,512,713 A * 4/1985 Berfield ..... 415/119
4,538,971 A * 9/1985 Miller et al. ..... 417/423.2
4,655,694 A * 4/1987 Berfield ..... 417/423.2
4,693,734 A 9/1987 Erickson, Jr.
5,030,257 A * 7/1991 Kasper et al. ..... 96/333
6,192,551 B1 * 2/2001 Roth ..... 15/413

* cited by examiner

*Primary Examiner*—Terrence R. Till
(74) *Attorney, Agent, or Firm*—Merchant & Gould

(57) ABSTRACT

In a vacuum cleaner with a motor suction assembly (8) comprising a motor part and a suction part (6) providing a carrier air stream and a cooling air stream, respectively, the motor suction assembly (8) is built into a cover (7, 12, 13) with a cylindrical cavity (23). The cover (7, 12, 13) separates the carrier air stream from the cooling air stream, said cover thus being sealed (14) against the motor suction assembly (8) in such a way that the carrier air stream cannot be affected by the cooling air stream and vice versa. Furthermore, the motor suction assembly (8) is surrounded and protected by the cover (12, 13). In this way, a construction is provided using only one cover, eliminating the need to position two covers, one of which solely serves to separate the air streams, while the other cover, together with the first one, provide a compartment for receiving the motor suction assembly (8). Thus, in other words, two covers are replaced by a universal cover (12, 13).

8 Claims, 2 Drawing Sheets

INSTALLATION OF A MOTOR IN A VACUUM CLEANER

FIELD OF THE INVENTION

The invention relates to a motor assembly for a vacuum cleaner of the type in which a motor suction assembly comprising a motor part and a suction part is located in a casing that is partitioned in such a way that a carrier air stream provided by the motor suction assembly is separated from a motor cooling air stream by a cover having a first and a second compartment.

BACKGROUND OF THE INVENTION

Usually, vacuum cleaners with a certain level of power consumption have motor suction assemblies providing two air streams, one of which is a so-called carrier air stream, which is used as carrier air for the build-up of suction and absorption of material in a collecting container.

The other air stream serves to cool the motor suction assembly during operation thereof.

In order to obtain electrical safety and an optimum cooling of the motor suction assembly, it is necessary that the above-mentioned 2 air streams be separated from each other into 2 separate air streams.

So far this separation has, for example, been effected by a motor suction assembly equipped with two covers, one of which served to separate the two air streams from each other, whereas the other cover served to encapsulate the motor suction assembly and to define a channel for cooling air together with the first cover.

U.S. Pat. No. 4,114,231 discloses a motor assembly located in a casing partitioned so that a carrier air stream provided by the motor suction assembly is separated from a motor cooling air stream provided by the motor suction assembly. In this assembly the motor is fastened to a vertical wall by screws and rivets. The two compartments are separated by this wall.

BRIEF SUMMARY OF THE INVENTION

It is an object of the invention to provide a construction of building a motor suction assembly into a vacuum cleaner, said construction consisting of fewer parts, thus making the production of the vacuum cleaner less expensive.

The object of the invention is fulfilled by a motor assembly in which two compartments are separated by a side wall, and the side wall is connected to an upper part of a plate part of the cover and to an upper surface of the suction part.

Thus, it is only necessary to use one universally applicable cover, the cover serving partly as a separation wall between the carrier air stream and the motor cooling air stream, and further serving as a casing for at least parts of the motor suction assembly.

Appropriate embodiments of the invention are set out in the other claims.

In particular, it should be noted that since parts of the motor suction assembly are included in a part of the construction separating the carrier air stream from the motor cooling air stream, the provision of a compact construction is provided.

In the following, the invention will be discussed In greater detail with reference to the exemplary embodiments shown in the drawing in which:

BRIEF DESCRIPTION OF THE DRAWINGS

FIG. 1 shows schematically the principles of the invention applied in connection with a central vacuum cleaner, whereas

DETAILED DESCRIPTION OF DISCLOSED EMBODIMENTS

Initially it should be noted that identical reference numbers in the 2 figures refer to identical parts of the 2 embodiments.

Figure 1:
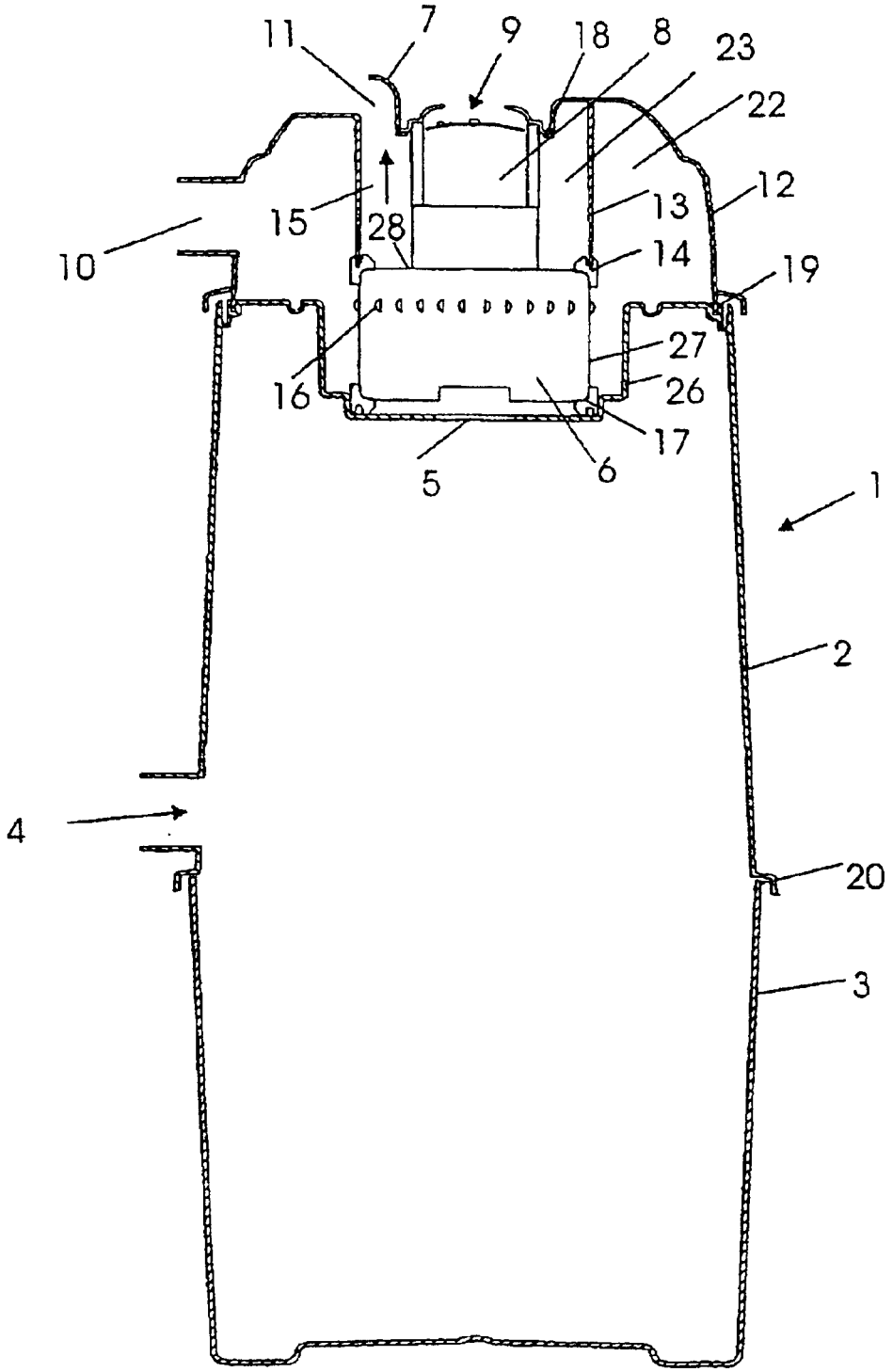

In FIG. 1, 1 denotes a vacuum cleaner with two container parts 2, 3 joined together by an attachment device such as a spring lock with reference number 20.

It is noted that the container part 2 has a connection piece 4 for receiving a vacuum cleaner hose or a tube (not shown).

A casing is attached to the upper container part 2, consisting of a cover 7, 12, 13 affixable to the container part 2 and a plate part 26.

As can be seen, the cover 7, 12, 13 delimits two compartments 22, 23, one of which 23, which is cylindrical, is defined by a side wall 13 of the cover, an upper surface 28 of a suction part 6 of a motor suction assembly 8 and by the plate part 12.

The same parts except the upper surface 28 of the suction part 6 delimit the other compartment 22.

Instead the compartment is delimited by a vertical cylindrical surface 27 of the suction part 6.

In the compartment 22, a connection piece or a discharge opening 10 is provided for air.

In the other compartment 23, a connection piece or a discharge opening 11 is also provided.

As is furthermore seen, the compartments 22 and 23 are sealed from each other by sealing means denoted by reference number 14. Packing rings can e.g. constitute these sealing means.

During operation of the vacuum cleaner, the motor suction assembly 8 will produce a carrier air stream carrying absorbed material, which is fed to the container, wherein a bag (not shown) receives the material via the connection piece while the air is fed further on through an opening 5 and through openings 16 of the suction part 6 and further out through the discharge opening 10.

Furthermore, the motor suction assembly provides a motor cooling air input at 9 on top of the motor suction part 8 and flowing out close to the upper surface 28 of openings (not shown) in a cylindrical surface 27, and then further on in the direction of the arrow 15 towards the discharge opening 11.

As will be apparent, the carrier air stream and the motor cooling air stream are completely separated from each other during operation of the vacuum cleaner.

Finally, FIG. 1 shows a packing ring 17 ensuring that the carrier air fed through the opening 5 flows through the openings 16.

Figure 2:
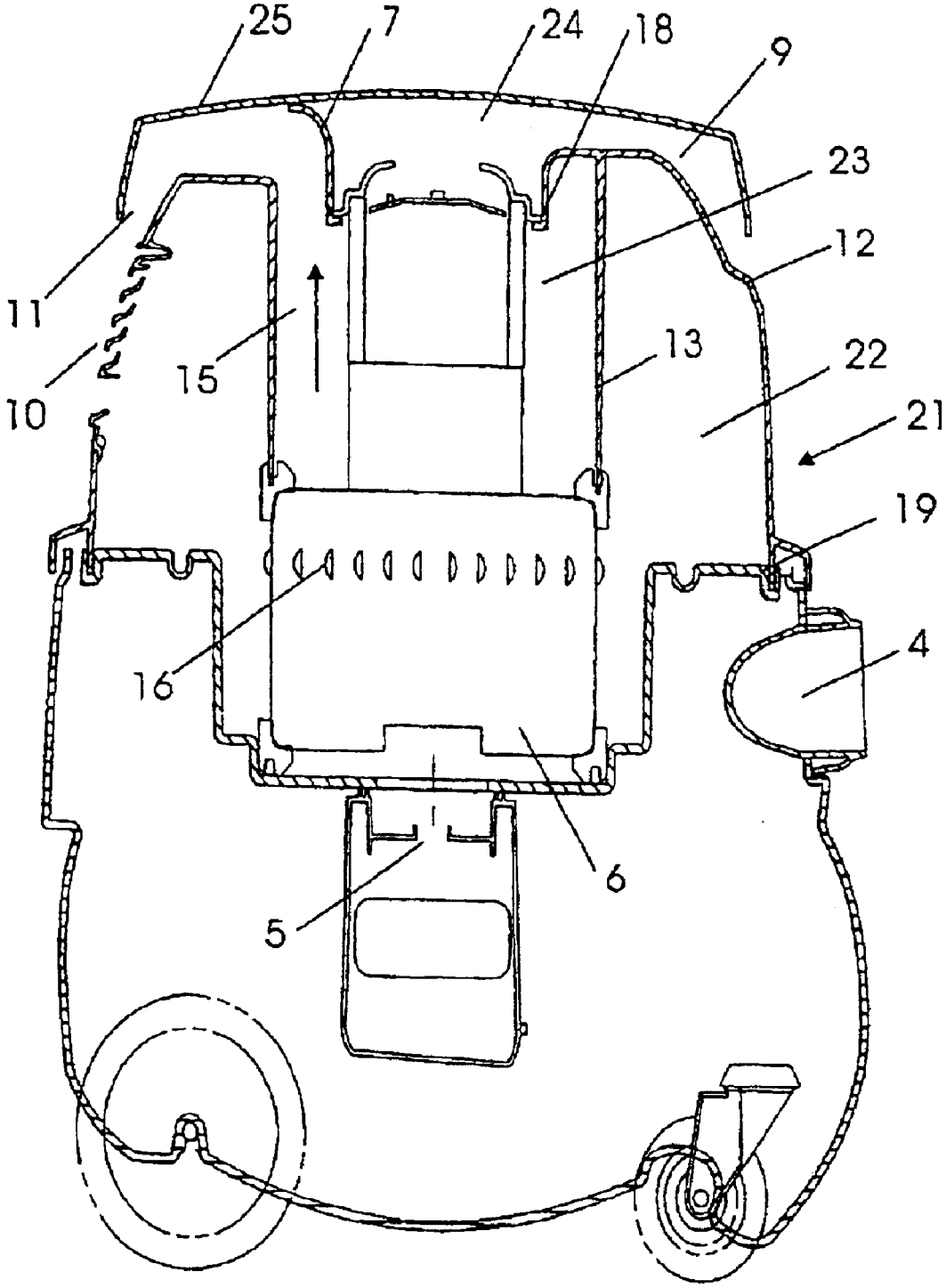
FIG. 2 shows schematically the principles of the invention applied in connection with a vacuum cleaner capable of absorbing both air and liquid.

FIG. 2 shows a type of vacuum cleaner adapted to absorb solid as well as liquid material. The construction of the vacuum cleaner of FIG. 2 is identical to that shown in FIG. 1, and so any parts corresponding to each other in the two figures will not be explained in more detail.

As can be seen, the vacuum cleaner according to FIG. 2 is equipped with a lid 25 at its upper end. Indeed, this lid could also have been provided on the vacuum cleaner of FIG. 1.

Carrier air stream and motor cooling air stream flow as explained in connection with FIG. 1.

Even though the invention is explained in connection with 2 specific embodiments of vacuum cleaners, there is nothing to prevent the use of the principles of the invention within the scope of the claims in connection with other cleaning equipment, in which a motor suction assembly provides a carrier air and a motor cooling air.

What is claimed is:

1. A motor assembly for a vacuum cleaner in which a motor suction assembly (8) including a motor part and a suction part (6) is located in a casing affixable to a container (2) of the vacuum cleaner, the motor assembly comprising:

a cover having a plate part (12) operative for attachment (19) to the container and forming an outermost extent of the casing, the plate part having an upper part;

a side wall (13) connected to the upper part of the plate part and extending downwardly from the upper part to define a first compartment (23) and a second compartment (22) separated by the side wall;

the side wall (13) being connected to an upper surface (28) of the suction part of the motor suction assembly received in the motor assembly so that the first compartment is adapted to receive a motor cooling air stream from the motor suction assembly; and the side wall being spaced apart from the plate part forming the outermost extent of the casing so that the second compartment is defined between the side wall and the plate part and is adapted to receive a carrier air stream from the motor suction assembly, whereby the cover provides a casing for the motor suction assembly and also provides a separation wall between the carrier air stream and the motor suction assembly.

2. A motor assembly according to claim 1, characterized in that the wall (13) and the upper surface (28) are sealed by a sealing member (14).

3. A motor assembly according to claim 1, characterized in that the first compartment (23) is cylindrical.

4. A motor assembly according to claim 3, characterized in that the bottom of the cylindrical compartment is constituted by the surface (28) of the suction part (6).

5. A motor assembly according to claim 1, characterized in that the cover (7, 12, 13) is further attached (19) to the container.

6. A motor assembly according to claim 1, characterized in that the suction part (6) is sealingly attached to a plate part (26) of the other compartment (22).

7. A motor assembly according to claim 1, characterized in that the carrier air stream flows partially in the other compartment (22).

8. A motor assembly according to claim 1, characterized in that the other compartment (22) is delimited by the cover (7, 12, 13), by a vertical cylindrical surface (27) of the suction part (6) and the plate part (26).

* * * * *